US008170440B2

(12) United States Patent
Sekovski et al.

(10) Patent No.: US 8,170,440 B2
(45) Date of Patent: May 1, 2012

(54) METHOD AND APPARATUS FOR COROTRON CLEANING MANAGEMENT IN AN IMAGE PRODUCTION DEVICE

(75) Inventors: David Sekovski, Rochester, NY (US); Evan Kastner, Rochester, NY (US); Robert Arnold Gross, Penfield, NY (US); David Kenneth Ahl, Rochester, NY (US); Alfred Claflin, Ontario, NY (US); Douglas McKeown, Geneseo, NY (US); John Chinnici, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 739 days.

(21) Appl. No.: 12/245,829

(22) Filed: Oct. 6, 2008

(65) Prior Publication Data

US 2010/0086316 A1 Apr. 8, 2010

(51) Int. Cl.
*G03G 15/02* (2006.01)

(52) U.S. Cl. ..... 399/100

(58) Field of Classification Search ..... 399/8, 34, 399/100
See application file for complete search history.

(56) References Cited

U.S. PATENT DOCUMENTS

2004/0156055 A1* 8/2004 Matsui et al. ..... 358/1.1
2005/0207778 A1* 9/2005 Yamashita ..... 399/100

* cited by examiner

*Primary Examiner* — David Gray
*Assistant Examiner* — Barnabas Fekete
(74) *Attorney, Agent, or Firm* — Ronald E. Prass, Jr.; Prass LLP

(57) ABSTRACT

A method and apparatus for corotron cleaning management in an image production device is disclosed. The method may include receiving an input from the corotron cleaning counter, determining if the corotron cleaning counter exceeds a predetermined threshold, wherein if it is determined that the corotron cleaning counter exceeds the predetermined threshold, notifying a maintainer that the corotron requires cleaning, determining if corotron cleaning has been performed, wherein if it is determined that corotron cleaning has been performed, resetting the corotron cleaning counter.

18 Claims, 5 Drawing Sheets

METHOD AND APPARATUS FOR COROTRON CLEANING MANAGEMENT IN AN IMAGE PRODUCTION DEVICE

BACKGROUND

Disclosed herein are a method and apparatus for corotron cleaning management in an image production device.

Manual corotron cleaners in image production devices rely on machine operators, machine maintenance, and/or field engineers to perform the cleaning operation. However, in conventional devices, there are no notifications given to a machine maintainer concerning the need to perform a corotron cleaning. The conventional approach is to require operators to service corotrons at convenient times, such as when other required maintenance is being performed. This process results in inadequate corotron cleaning, shortened device life, and higher run costs for the device.

SUMMARY

A method and apparatus for corotron cleaning management in an image production device is disclosed. The method may include receiving an input from the corotron cleaning counter, determining if the corotron cleaning counter exceeds a predetermined threshold, wherein if it is determined that the corotron cleaning counter exceeds the predetermined threshold, notifying a maintainer that the corotron requires cleaning, determining if corotron cleaning has been performed, wherein if it is determined that corotron cleaning has been performed, resetting the corotron cleaning counter.

DETAILED DESCRIPTION

Aspects of the embodiments disclosed herein relate to a method and apparatus for corotron cleaning management in an image production device.

The disclosed embodiments may include a method for corotron cleaning management in an image production device. The method may include receiving an input from the corotron cleaning counter, determining if the corotron cleaning counter exceeds a predetermined threshold, wherein if it is determined that the corotron cleaning counter exceeds the predetermined threshold, notifying a maintainer that the corotron requires cleaning, determining if corotron cleaning has been performed, wherein if it is determined that corotron cleaning has been performed, resetting the corotron cleaning counter.

The disclosed embodiments may further include an image production device that may include a corotron cleaning counter that counts documents processed by the image production device; and a corotron cleaning management unit that receives input from the corotron cleaning counter, determines if the corotron cleaning counter exceeds a predetermined threshold, wherein if the corotron cleaning management unit determines that the corotron cleaning counter exceeds the predetermined threshold, the corotron cleaning management unit notifies a maintainer that the corotron requires cleaning, determines if corotron cleaning has been performed, wherein if the corotron cleaning management unit determine that corotron cleaning has been performed, the corotron cleaning management unit resets the corotron cleaning counter.

The disclosed embodiments may further include computer-readable medium storing instructions for controlling a computing device for corotron cleaning management in an image production device. The instructions may include receiving an input from the corotron cleaning counter, determining if the corotron cleaning counter exceeds a predetermined threshold, wherein if it is determined that the corotron cleaning counter exceeds the predetermined threshold, notifying a maintainer that the corotron requires cleaning, determining if corotron cleaning has been performed, wherein if it is determined that corotron cleaning has been performed, resetting the corotron cleaning counter.

Figure 5:
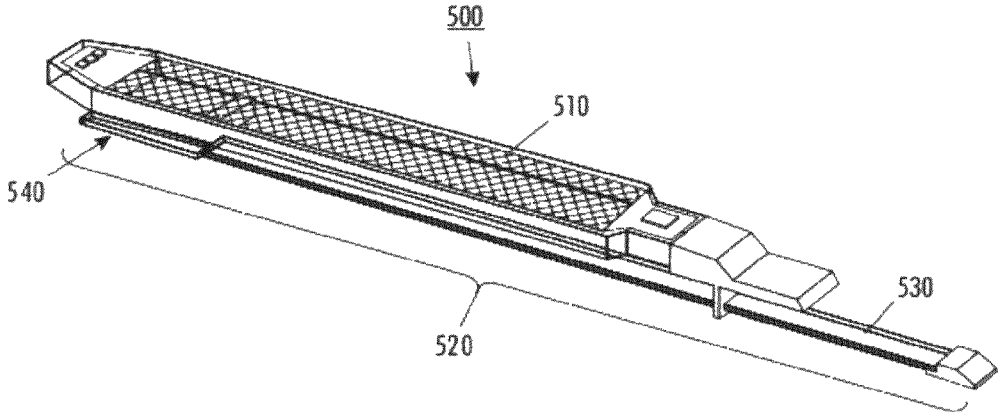
FIG. 5 is a diagram of an exemplary corotron device in accordance with one possible embodiment of the disclosure.

FIG. 5 is a diagram of an exemplary corotron device 500 in accordance with one possible embodiment of the disclosure. The exemplary corotron device 500 may include a corotron 510 (or other corona device, such as the corotron as shown), and a manual corotron cleaning device 520 that may include a wand 530 connected to one or more brushes 540. The corotron 510 serves the purpose of electrically charging a carrier material for a forming an image in the image production device.

In particular image production devices, image quality may be affected if the corotron 510 is not cleaned at a proper interval. Thus, the corotron 510 must be cleaned manually using the manual corotron cleaning device 520. An operator or maintainer may push and pull the wand 530 which will enable the one or more brushes 540 to clean the corotron 510. The wand 530 may push-pulled one or more times to ensure that the corotron is properly cleaned. However, if corotron cleaning is performed in a timely fashion, image quality may suffer (if cleaning is too infrequent) or corotron life may be shortened (if cleaned too frequently).

The disclosed embodiments may concern a messaging system for communicating to an image production device maintainer or operator that the device's corotron must be cleaned. This process may use a corotron cleaning counter and a corotron cleaning management unit, in conjunction with the FIG. 5 components and a home sensor (which may sense that the wand 540 is back in its proper storage location in order to avoid damage to the image production device).

The corotron cleaning management unit may track the interval between manual device cleanings using the corotron cleaning counter to increment with each copy, image panel, etc. The corotron cleaning counter may be reset upon successful completion of one or more cleaning pass. When the corotron cleaning counter reading indicates that the interval required for optimum cleaning performance has been reached, a message may be displayed to the machine operator requesting a cleaning operation be performed. The messages may communicate the need for cleaning, a need to optimize the rate of cleaning, or other cleaning parameters, for example. As a result of this process, the message reminders may enable efficient cleaning to permit improved device life, improved image quality, and improved run costs.

Figure 1:
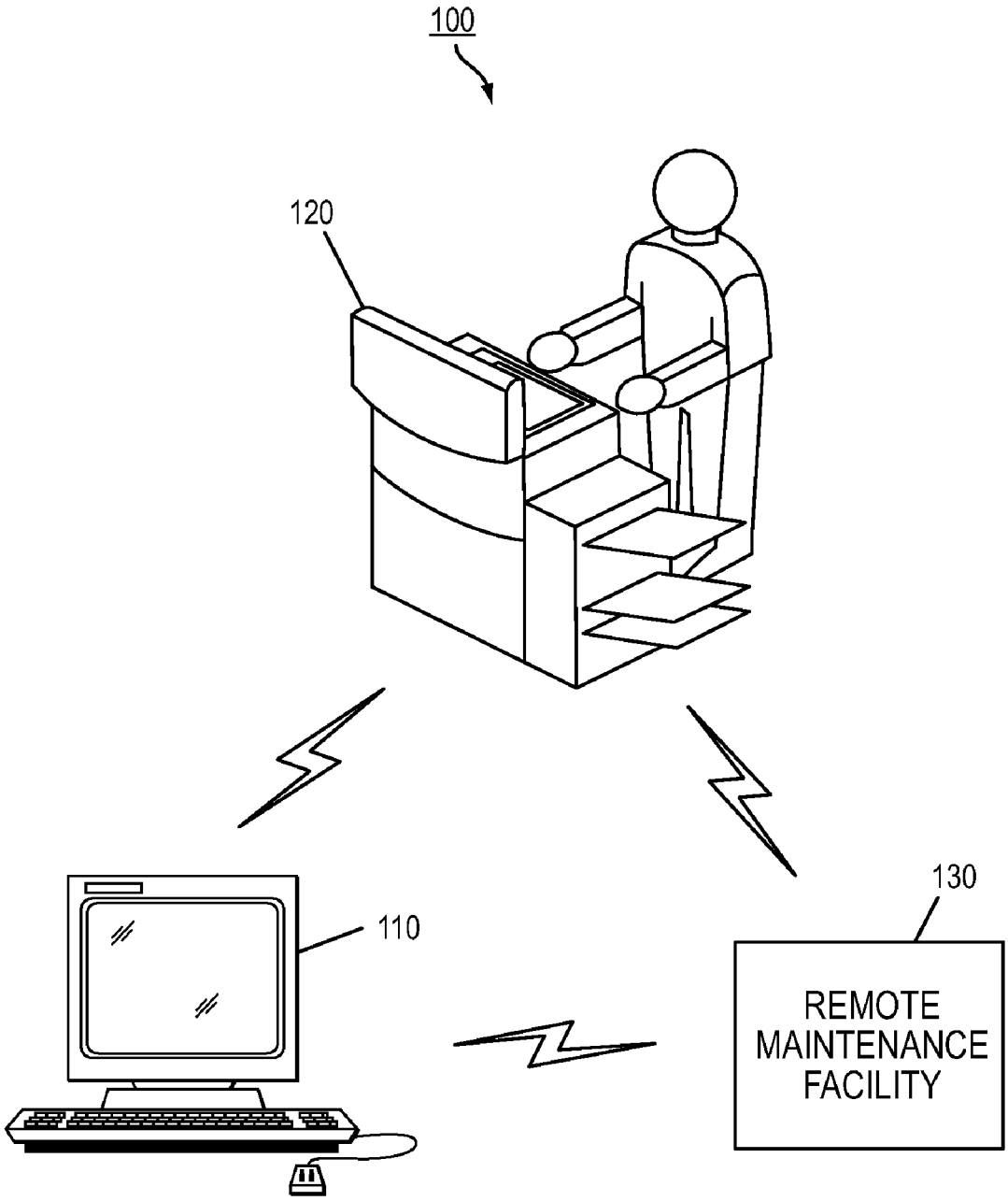
FIG. 1 is an exemplary diagram of an image production environment in accordance with one possible embodiment of the disclosure.

FIG. 1 is an exemplary diagram of an image production environment 100 in accordance with one possible embodiment of the disclosure. The image production environment 100 may include a processing device 110 that may be hardwired or wirelessly connected to an image production device 120.

The processing device 110 may be any device that communicates with the image production device 120, including a computer, a server, a telephone, or a personal digital assistant, for example. The image production device 120 may be any device that may be capable of printing documents, including a printer, a copier/printer, an office copier/printer, a high-capacity copier/printer, a commercial copier/printer, a facsimile/printer device, or a multi-function device, for example.

The remote maintenance facility 130 may represent any remote facility where messages may be sent via a communications network to an image production device, maintainer, technician, operator, etc. Messages may be sent from the image production device 120 or a processing device 110 communicating with the image production device to a computer at the remote maintenance facility 130 via the Internet, through e-mail, or other messaging software, for example, so that the messages may be received and displayed to the maintainers.

Figure 2:
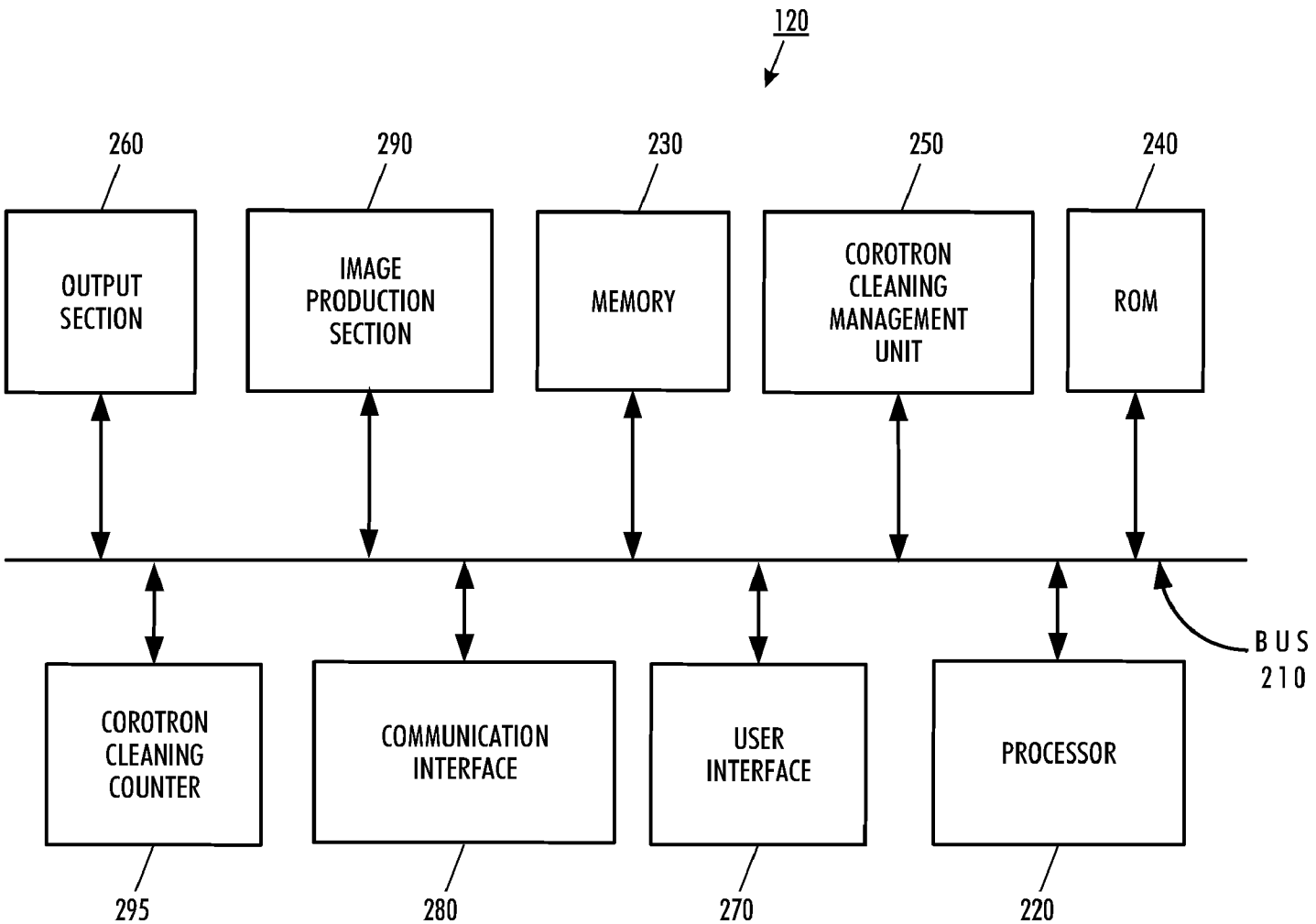
FIG. 2 is an exemplary block diagram of an image production device in accordance with one possible embodiment of the disclosure.

FIG. 2 is an exemplary block diagram of an image production device 120 in accordance with one possible embodiment of the disclosure. The image production device 120 may include a bus 210, a processor 220, a memory 230, a read only memory (ROM) 240, a corotron cleaning management unit 250, an output section 260, a user interface 270, a communication interface 280, an image production section 290, and a corotron cleaning counter 295. Bus 210 may permit communication among the components of the image production device 120.

Processor 220 may include at least one conventional processor or microprocessor that interprets and executes instructions. Memory 230 may be a random access memory (RAM) or another type of dynamic storage device that stores information and instructions for execution by processor 220. Memory 230 may also include a read-only memory (ROM) which may include a conventional ROM device or another type of static storage device that stores static information and instructions for processor 220.

Communication interface 280 may include any mechanism that facilitates communication via a network. For example, communication interface 280 may include a modem. Alternatively, communication interface 280 may include other mechanisms for assisting in communications with other devices and/or systems.

ROM 240 may include a conventional ROM device or another type of static storage device that stores static information and instructions for processor 220. A storage device may augment the ROM and may include any type of storage media, such as, for example, magnetic or optical recording media and its corresponding drive.

User interface 270 may include one or more conventional mechanisms that permit a user to input information to and interact with the image production unit 100, such as a keyboard, a display, a mouse, a pen, a voice recognition device, touchpad, buttons, etc., for example. Output section 260 may include one or more conventional mechanisms that output image production documents to the user, including output trays, output paths, finishing section, etc., for example. The image production section 290 may include an image printing section, a scanner, a fuser section, a toner section, etc., for example.

Corotron cleaning counter 295 may represent any software or hardware mechanism that may count the number of pages processed, image panels processed, copies made, prints made, or image production documents processed, for example.

The image production device 120 may perform such functions in response to processor 220 by executing sequences of instructions contained in a computer-readable medium, such as, for example, memory 230. Such instructions may be read into memory 230 from another computer-readable medium, such as a storage device or from a separate device via communication interface 280.

The image production device 120 illustrated in FIGS. 1-2 and the related discussion are intended to provide a brief, general description of a suitable communication and processing environment in which the disclosure may be implemented. Although not required, the disclosure will be described, at least in part, in the general context of computer-executable instructions, such as program modules, being executed by the image production device 120, such as a communication server, communications switch, communications router, or general purpose computer, for example.

Generally, program modules include routine programs, objects, components, data structures, etc. that perform particular tasks or implement particular abstract data types. Moreover, those skilled in the art will appreciate that other embodiments of the disclosure may be practiced in communication network environments with many types of communication equipment and computer system configurations, including personal computers, hand-held devices, multi-processor systems, microprocessor-based or programmable consumer electronics, and the like.

Figure 3:
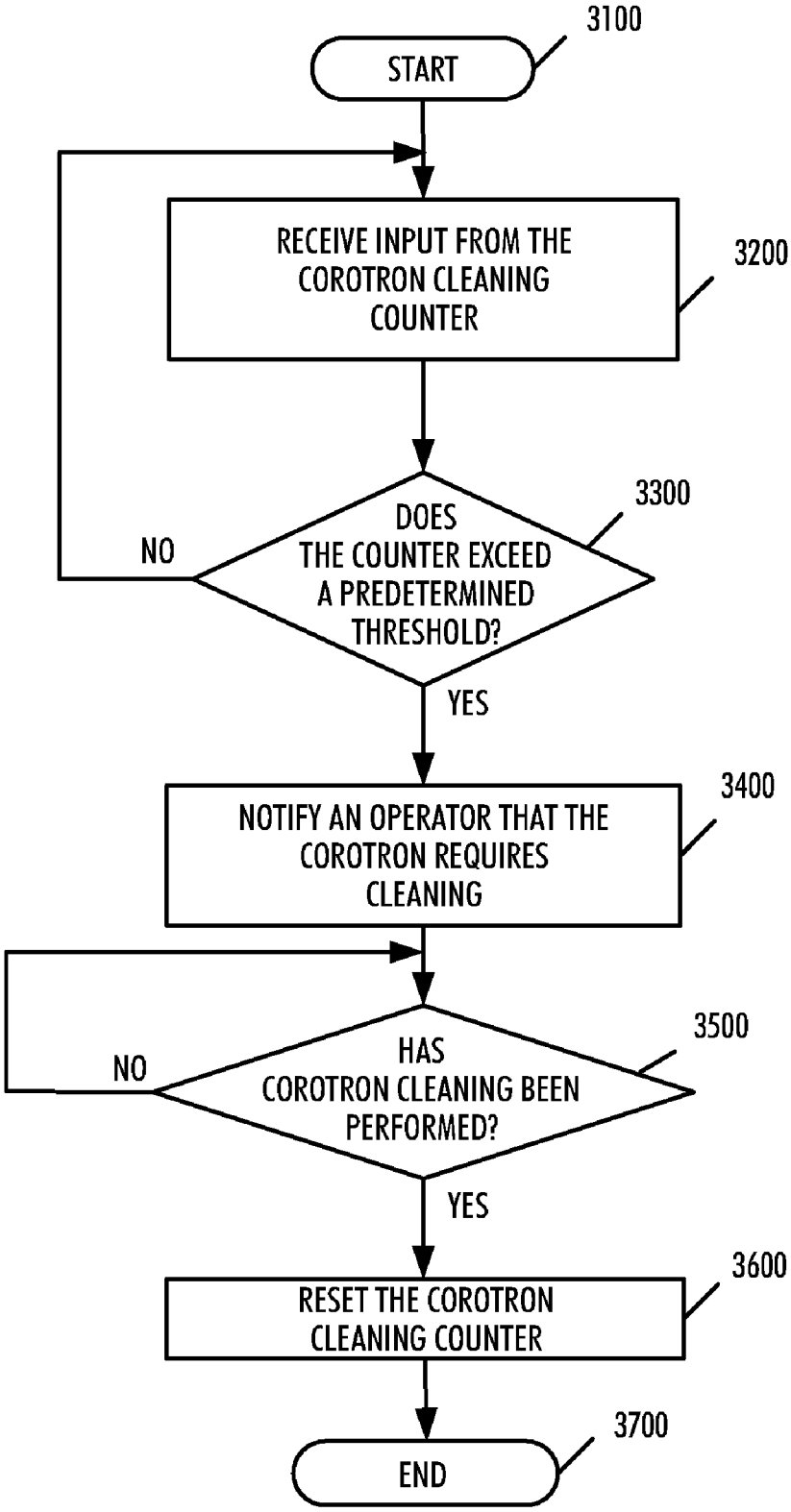
FIG. 3 is a flowchart of an exemplary corotron cleaning management process in accordance with one possible embodiment of the disclosure.

For illustrative purposes, the operation of the corotron cleaning management unit 250 and the exemplary corotron cleaning management process are described in FIG. 3 in relation to the diagrams shown in FIGS. 1-2.

FIG. 3 is a flowchart of an exemplary corotron cleaning management process in accordance with one possible embodiment of the disclosure. The process may begin at step 3100, and continues to step 3200 where the corotron cleaning management unit 250 may receive input from the corotron cleaning counter 295.

At step 3300 the corotron cleaning management unit 250 may determine if the corotron cleaning counter 295 exceeds a predetermined threshold. The predetermined threshold may be any number of prints, documents, pages, images, etc. that may be produced before the corotron is deemed to require cleaning. If the corotron cleaning management unit 250 determines that the corotron cleaning counter 295 does not exceed the predetermined threshold, the process returns to step 3200.

If at step 3300, the corotron cleaning management unit 250 determines that the corotron cleaning counter 295 exceeds the predetermined threshold, then at step 3400, the corotron cleaning management unit 250 may notify a maintainer that the corotron requires cleaning. The corotron cleaning management unit 250 may notify the maintainer by sending a message to the user interface 270 of the image production device 120, by sending a message to a remote maintenance facility 130, or by sending a message to a processing device 110, for example.

At step 3500, the corotron cleaning management unit 250 may determine if corotron cleaning has been performed. The corotron cleaning management unit 250 may determine if the corotron 510 has been cleaned by prompting the maintainer to indicate that the corotron 510 has been cleaned on the user interface 270, for example. The corotron cleaning management unit 250 may then receive the indication from the maintainer that the corotron 510 has been cleaned. Alternatively, the corotron cleaning management unit 250 may determine if the corotron 510 has been cleaned by receiving a signal from the home sensor that the cleaning wand 530 has been placed back in its proper storage position, for example.

If the corotron cleaning management unit 250 determines that corotron cleaning has not been performed, the process returns to step 3500. If at step 3500, the corotron cleaning management unit 250 determines that corotron cleaning has been performed, then at step 3600, the corotron cleaning management unit 250 may reset the corotron cleaning counter 295. Note that the resetting of the corotron cleaning counter 295 may be to zero if the counter is incremented, or to a particular predetermined number if the counter 295 is decremented. The process may then go to step 3800, and end.

Figure 4:
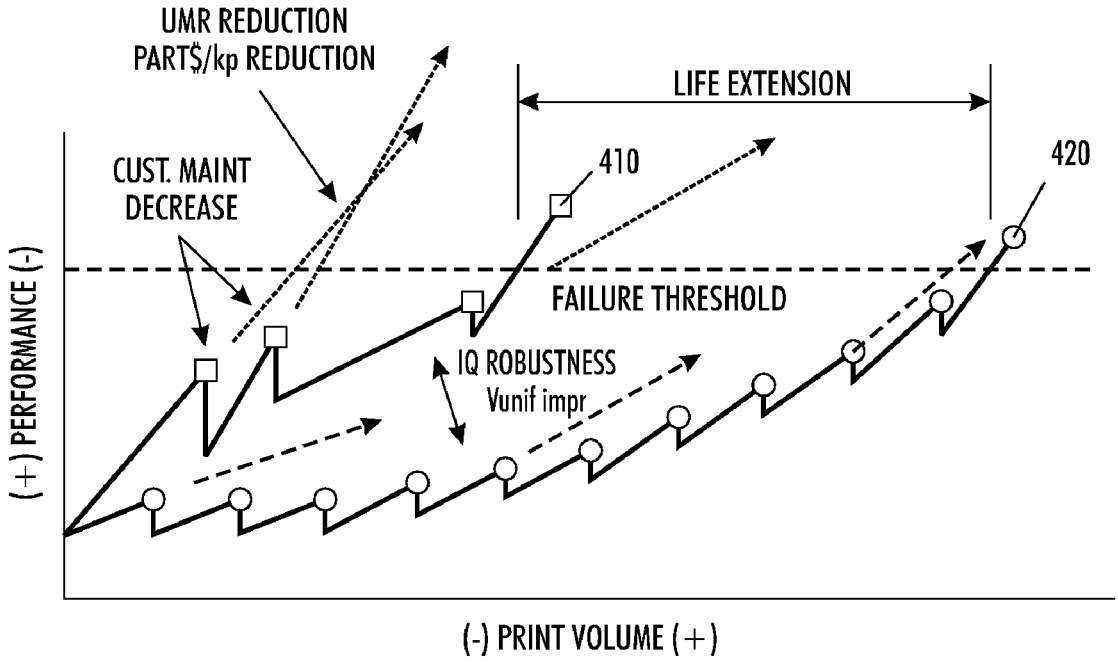
FIG. 4 is a diagram illustrating the improved performance as a result of the corotron cleaning management process in accordance with one possible embodiment of the disclosure.

FIG. 4 is a diagram illustrating the improved performance as a result of the corotron cleaning management process in accordance with one possible embodiment of the disclosure. Advance warning reminder messages can be very effective at influencing behavior of individuals toward a desired outcome. The line 410 shows irregular manual corotron cleanings and resultant costs. The line 420 shows improved regular corotron cleaning with messaging reminders. As shown, the result is increased corotron life, improved image quality, and reduced run costs.

Embodiments as disclosed herein may also include computer-readable media for carrying or having computer-executable instructions or data structures stored thereon. Such computer-readable media can be any available media that can be accessed by a general purpose or special purpose computer. By way of example, and not limitation, such computer-readable media can comprise RAM, ROM, EEPROM, CD-ROM or other optical disk storage, magnetic disk storage or other magnetic storage devices, or any other medium which can be used to carry or store desired program code means in the form of computer-executable instructions or data structures. When information is transferred or provided over a network or another communications connection (either hard-wired, wireless, or combination thereof to a computer, the computer properly views the connection as a computer-readable medium. Thus, any such connection is properly termed a computer-readable medium. Combinations of the above should also be included within the scope of the computer-readable media.

Computer-executable instructions include, for example, instructions and data which cause a general purpose computer, special purpose computer, or special purpose processing device to perform a certain function or group of functions. Computer-executable instructions also include program modules that are executed by computers in stand-alone or network environments. Generally, program modules include routines, programs, objects, components, and data structures, and the like that perform particular tasks or implement particular abstract data types. Computer-executable instructions, associated data structures, and program modules represent examples of the program code means for executing steps of the methods disclosed herein. The particular sequence of such executable instructions or associated data structures represents examples of corresponding acts for implementing the functions described therein. It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A method for corotron cleaning management in an image production device, comprising:

receiving an input from the corotron cleaning counter;

determining if the corotron cleaning counter exceeds a predetermined threshold, wherein if it is determined that the corotron cleaning counter exceeds the predetermined threshold, notifying a maintainer that the corotron requires cleaning;

determining if corotron cleaning has been performed, wherein if it is determined that corotron cleaning has been performed, resetting the corotron cleaning counter;

prompting the maintainer to indicate that the corotron has been cleaned; and receiving the indication from the maintainer that the corotron has been cleaned.

2. The method of claim 1, wherein the maintainer is notified by sending a message to the user interface of the image production device.

3. The method of claim 1, wherein the maintainer is notified by sending a message to a remote maintenance facility.

4. The method of claim 1, wherein the maintainer is notified by sending a message to a processing device.

5. The method of claim 1, wherein the corotron cleaning counter counts at least one of the number of pages processed, the image panels processed, the number of copies made, the number of prints made, and the image production documents processed.

6. The method of claim 1, wherein the image production device is one of a printer, a copier/printer, an office copier/printer, a high-capacity copier/printer, a commercial copier/printer, a facsimile/printer device, and a multi-function device.

7. An image production device, comprising:

a corotron cleaning counter that counts documents processed by the image production device; and a corotron cleaning management unit that receives input from the corotron cleaning counter, determines if the corotron cleaning counter exceeds a predetermined threshold, wherein if the corotron cleaning management unit determines that the corotron cleaning counter exceeds the predetermined threshold, the corotron cleaning management unit notifies a maintainer that the corotron requires cleaning, determines if corotron cleaning has been performed, wherein if the corotron cleaning management unit determine that corotron cleaning has been performed, the corotron cleaning management unit resets the corotron cleaning counter; wherein the corotron cleaning management unit prompts the maintainer to indicate that the corotron has been cleaned, and receives the indication from the maintainer that the corotron has been cleaned.

8. The image production device of claim 7, wherein the corotron cleaning management unit notifies the maintainer by sending a message to the user interface of the image production device.

9. The image production device of claim 7, wherein the corotron cleaning management unit notifies the maintainer by sending a message to a remote maintenance facility.

10. The image production device of claim 7, wherein the corotron cleaning management unit notifies the maintainer by sending a message to a processing device.

11. The image production device of claim 7, wherein the corotron cleaning counter counts at least one of the number of pages processed, the image panels processed, the number of copies made, the number of prints made, and the image production documents processed.

12. The image production device of claim 7, wherein the image production device is one of a printer, a copier/printer, an office copier/printer, a high-capacity copier/printer, a commercial copier/printer, a facsimile/printer device, and a multi-function device.

13. A computer-readable non-transitory medium storing instructions for controlling a computing device for corotron cleaning management in an image production device, the instructions comprising:

receiving an input from the corotron cleaning counter;

determining if the corotron cleaning counter exceeds a predetermined threshold, wherein if it is determined that the corotron cleaning counter exceeds the predetermined threshold, notifying a maintainer that the corotron requires cleaning;

determining if corotron cleaning has been performed, wherein if it is determined that corotron cleaning has been performed, resetting the corotron cleaning counter prompting the maintainer to indicate that the corotron has been cleaned; and receiving the indication from the maintainer that the corotron has been cleaned.

14. The computer-readable medium of claim 13, wherein the maintainer is notified by sending a message to the user interface of the image production device.

15. The computer-readable medium of claim 13, wherein the maintainer is notified by sending a message to a remote maintenance facility.

16. The computer-readable medium of claim 13, wherein the maintainer is notified by sending a message to a processing device.

17. The computer-readable medium of claim 13, wherein the corotron cleaning counter counts at least one of the number of pages processed, the image panels processed, the number of copies made, the number of prints made, and the image production documents processed.

18. The computer-readable medium of claim 13, wherein the image production device is one of a printer, a copier/printer, an office copier/printer, a high-capacity copier/printer, a commercial copier/printer, a facsimile/printer device, and a multi-function device.

* * * * *